US005398382A

United States Patent [19]

Leifeld

[11] Patent Number: 5,398,382

[45] Date of Patent: Mar. 21, 1995

[54] APPARATUS FOR REMOVING SLIVER RESIDUES FROM COILER CANS

[75] Inventor: Ferdinand Leifeld, Kempen, Germany

[73] Assignee: Trützschler GmbH & Co. KG, Mönchengladbach, Germany

[21] Appl. No.: 114,342

[22] Filed: Aug. 31, 1993

[30] Foreign Application Priority Data

Sep. 14, 1992 [DE] Germany ..... 42 30 741.4

[51] Int. Cl.[6] ..... D04H 11/00

[52] U.S. Cl. ..... 19/159 A; 19/157; 15/312.1

[58] Field of Search ..... 19/159 R, 159 A, 157, 19/65 A, 150; 406/151, 152, 153, 141, 142, 143; 15/312.1; 57/90, 281

[56] References Cited

U.S. PATENT DOCUMENTS

| | | | |
|---|---|---|---|
| 4,688,300 | 8/1987 | Langen et al. | 19/159 A |
| 4,987,649 | 1/1991 | Meyer et al. | 19/159 A |
| 5,276,947 | 1/1994 | Fritschi et al. | 19/159 A |
| 5,311,645 | 5/1994 | Schwalm et al. | 19/159 A |

FOREIGN PATENT DOCUMENTS

| | | |
|---|---|---|
| 531754 | 3/1993 | European Pat. Off. . |
| 48-8292 | 3/1973 | Japan . |
| 2181755 | 4/1987 | United Kingdom . |

*Primary Examiner*—Clifford D. Crowder
*Assistant Examiner*—Michael A. Neas
*Attorney, Agent, or Firm*—Spencer, Frank & Schneider

[57] ABSTRACT

An apparatus for removing sliver residues from a coiler can includes a transporting carriage for transporting a coiler can along a path of travel. The transporting carriage has an undercarriage; two generally vertically oriented walls supported on the undercarriage and having respective upper portions; a transverse beam interconnecting the walls at the upper portions thereof; a receiving bay defined together by the walls and the transverse beam for accommodating a coiler can; and a generally vertically oriented throughgoing aperture provided in the transverse beam and situated above the receiving bay. The apparatus further has a suction device including a suction nozzle being in alignment with the throughgoing aperture and extending from above theretoward when the transporting carriage is in position at the suction device.

21 Claims, 7 Drawing Sheets

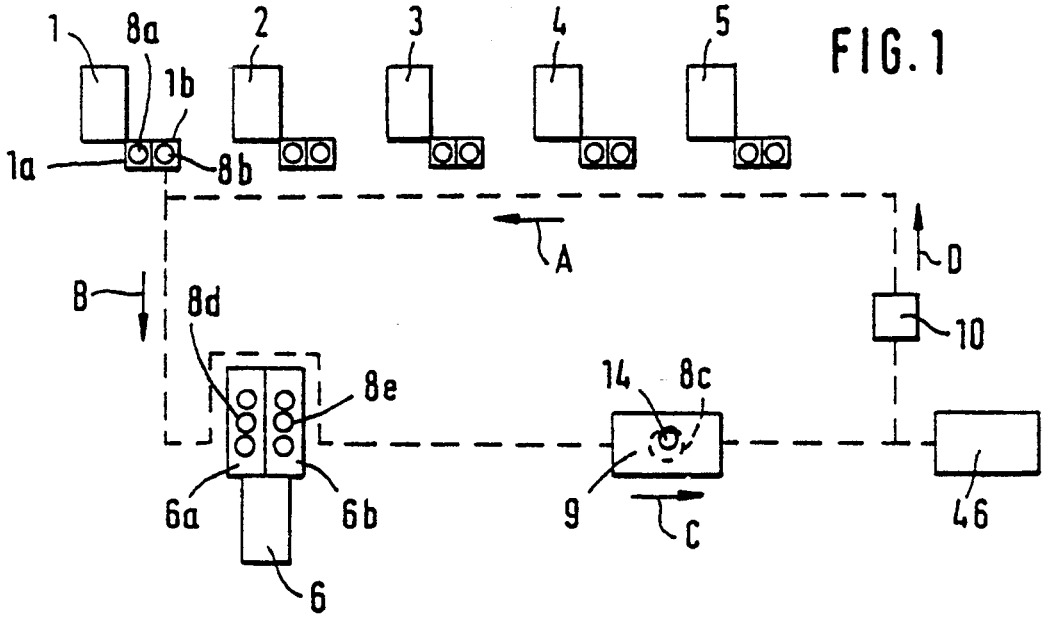
FIG. 1
FIG. 2
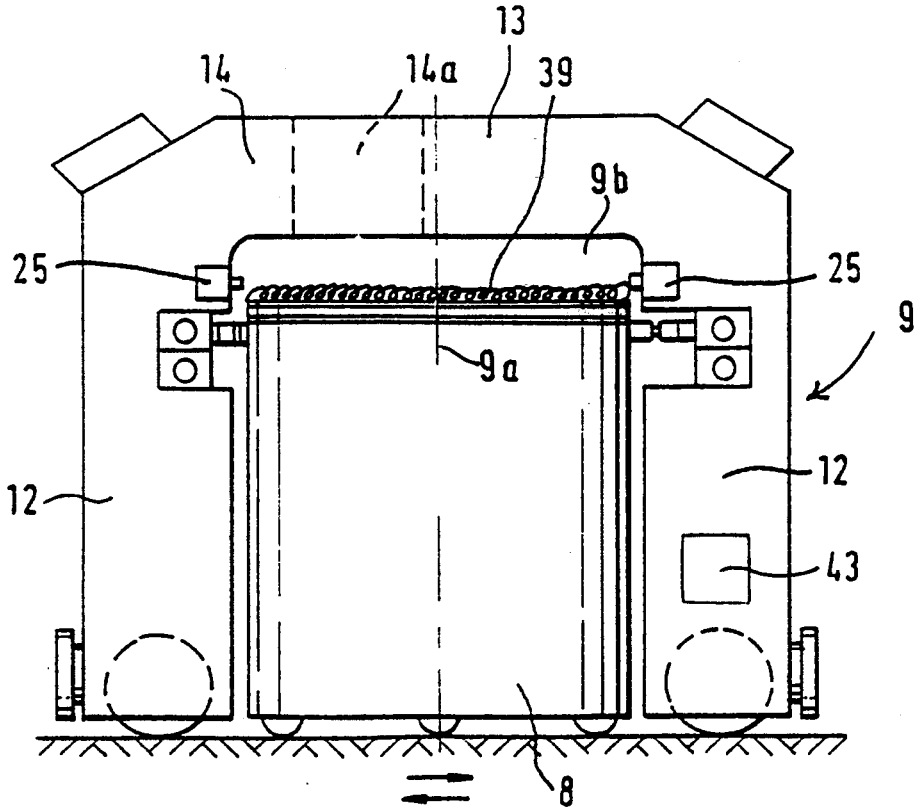

APPARATUS FOR REMOVING SLIVER RESIDUES FROM COILER CANS

CROSS REFERENCE TO RELATED APPLICATION

This application claims the priority of German Application No. P 42 30 741.4 filed Sep. 14, 1992.

BACKGROUND OF THE INVENTION

This invention relates to an apparatus for transporting coiler cans from a sliver consuming machine—such as a drafting frame—to a sliver producing machine—such as a carding machine—which charges the coiler can with sliver. More particularly, the invention relates to an apparatus which removes sliver residues from the coiler cans before they reach the sliver producing machine. The apparatus includes a coiler can transporting carriage and the coiler can, prior to being charged with sliver at the sliver producing machine, passes through a sliver can emptying device for removal of sliver residues that the coiler cans still may contain after the sliver has been paid out to the sliver consuming machine.

According to a known apparatus the coiler can is freely standing on a supporting platform of the carriage. For removing sliver residues from the coiler can, a mechanical sliver removing device is provided which, for example, may be of the mechanical contacting type or may be based on vacuum or air blasting operation. The sliver removing device may be moved into a sliver removal position and a fiber depositing position. In the fiber depositing position the sliver removing device transfers the removed fiber material to an intermediate storing device.

It is a disadvantage of prior art constructions that the sliver removing device adds to the complexity and expense of the fiber treating process and that the fiber removing device has to be switched between the removal position and the depositing position. It is also a drawback that in prior art constructions no support arrangements are provided at the transporting carriage for the coiler cans or for the sliver material projecting beyond the upper edge of the coiler can.

SUMMARY OF THE INVENTION

It is an object of the invention to provide an improved apparatus of the above-outlined type from which the discussed disadvantages are eliminated and which, in particular, makes possible to positively support the coiler can and the sliver material projecting upwardly therefrom and furthermore ensures a simple emptying of the coiler cans of the sliver residues.

This object and others to become apparent as the specification progresses, are accomplished by the invention, according to which, briefly stated, the apparatus for removing sliver residues from a coiler can includes a transporting carriage for transporting a coiler can along a path of travel. The transporting carriage has an undercarriage; two generally vertically oriented walls supported on the undercarriage and having respective upper portions; a transverse beam interconnecting the walls at the upper portions thereof; a receiving bay defined together by the walls and the transverse beam for accommodating a coiler can; and a generally vertically oriented throughgoing aperture provided in the transverse beam and situated above the receiving bay. The apparatus further has a suction device including a suction nozzle being in alignment with the throughgoing aperture and extending from above theretoward when the transporting carriage is in position at the suction device.

By virtue of the fact that the transverse beam of the transporting carriage is provided with a throughgoing aperture connectable at the top with a suction device, the transporting carriage, advancing the coiler can emptied earlier by the sliver consuming machine may stop underneath the suction device on its way from the drafting frame to the carding machine. The coiler can remains on the transporting carriage during the suction operation.

According to an advantageous embodiment the suction device is fixed in place. In this manner it is feasible to empty all coiler cans with a single suction device which is situated in the travel path of the transporting carriage without the need of removing the coiler cans from the transporting carriage.

In accordance with another advantageous embodiment of the invention, the throughgoing opening in the transverse beam of the transporting carriage is situated eccentrically relative to a central vertical axis of the carriage space that accommodates the coiler can. By virtue of such an eccentric location, during suction removal of the sliver residues, between the upper coiler can edge and the coiler can platform air turbulence is generated which enhances the removal of all sliver residues.

Expediently, the throughgoing opening in the transverse beam of the carriage is circular, whereby frictional losses are avoided during the suction process. The diameter of the opening is less than the diameter of the coiler can whereby relatively weak air streams may be used. The distance of the coiler can bottom from the upper coiler can edge may be set which enhances a turbulence effect and thus leads to an improved suction removal of the sliver residues.

Advantageously, the suction device includes a suction nozzle or the like which has a suction hood at one of its ends. The diameter of the nozzle end or the diameter of the suction hood is preferably greater than the diameter of the opening provided in the transverse beam and has a rubber seal surrounding the opening during operation.

Preferably, the transporting carriage or the suction device is provided with a position indicator, for example, a sensor or a photocell, by means of which an exact position of the transporting carriage underneath the suction device may be determined.

The invention has the following additional advantageous features:

- Between the suction nozzle and a suction fan a fiber separator is provided for separating the fiber material from the air stream. Underneath the fiber separator preferably a fiber storing device such as a fill chute is provided.
- Between the suction fan and the fiber separator a shutoff gate is provided through which the air stream may be separated out between the fiber separator and the suction fan.
- Between the fiber separator and the fiber storing device a switchable gate is provided and at the lower end of the fill chute a removal device such as two cooperating delivery rolls as well as a rapidly rotating opening roll are arranged.

The shutoff gate and the switchable gate are operated by controlled pneumatic or hydraulic pressure cylinders.

The position indicator and the drive motor for the transporting carriage are connected to a common electronic control and regulating device, for example, a microprocessor to which there are connected the control devices for the gates.

The transverse beam or the end of the suction nozzle is associated with a sensor, for example, a light sensor which determines the distance of the suction nozzle to the can base. In this manner, the degree of fill of the coiler can may be determined. Upon comparison with an earlier inputted, predetermined settable value the microprocessor may then determine the further course of the transporting carriage, that is, it may decide whether stoppage of the transporting carriage in the can emptying device is required because the presence of sliver residues in the coiler can has been determined or whether the coiler can may be directly transported to a sliver producing machine for filling the coiler can with sliver.

Between the transverse beam and the upper edge of the coiler can a height-adjustable hold-down element (such as a hold-down plate) is provided which has an aperture generally aligned with the aperture provided in the transverse beam of the transporting carriage. Such an embodiment simultaneously accomplishes two purposes: the fiber material projecting upwardly from the coiler can is securely held and further, by changing the position of the hold-down element, cans of different heights may be used.

At the aperture of the hold-down element a tubular attachment projects which extends into the opening of the transverse beam. In this manner, during the suction process the entry of undesired external air may be prevented to a large measure.

BRIEF DESCRIPTION OF THE DRAWINGS

FIG. 1 is a schematic top plan view of a spinning preparation system formed of five carding machines and a drafting frame, a coiler can transporting carriage and a coiler can emptying device.

FIG. 2 is a side elevational view of a coiler can transporting carriage including carrier walls, a transverse beam and accommodating a coiler can.

DESCRIPTION OF THE PREFERRED EMBODIMENTS

Figure 3:
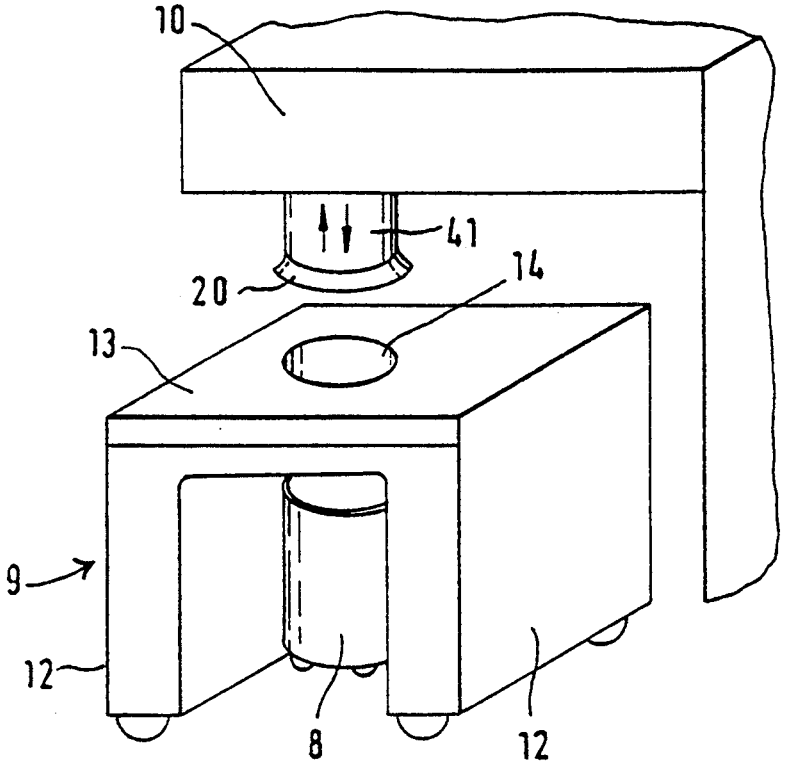
FIG. 3 is a perspective view of the transporting carriage shown in FIG. 2.

Turning to FIG. 1, the illustrated system for spinning preparation includes five carding machines 1, 2, 3, 4 and 5 and a drafting frame 6 having two side-by-side arranged coiler can supporting platforms 6*a* and 6*b*. With each carding machine 1–5 there is associated a feeding apparatus 1*a* for depositing sliver into coiler cans. Next to the sliver feeding device 1*a* a pickup station 1*b* is arranged to receive a coiler can which was previously filled with sliver in the station 1*a*. The coiler can in the station 1*a* is designated at 8*a* whereas the filled coiler can in pickup station 1*b* is designated at 8*b*. The feeding device 1*a* and the pickup station 1*b* may form part of a known coiler can changing (replacing) apparatus.

For conveying the coiler cans 8*c* to the drafting frame 6 from the cards 1–5 and back to the cards 1–5, a coiler can transporting carriage 9 is provided which conveys the coiler cans 8*c*, along a path shown in broken lines, in the direction of the arrows A and B from the cards 1–5 to the drafting frame 6 and in the direction of the arrows C and D from the drafting frame 6 to the carding machines 1–5. The transporting carriage 9 may be a bottomless CANNY model manufactured by Trützschler GmbH & Co. KG, Mönchengladbach, Germany. It will be understood, however, that a transporting carriage with a can-supporting bottom may also be used. The six coiler cans designated at 8*d* and 8*e* form two coiler can rows on respective support platforms 6*a* and 6*b* of the drafting frame 6. The coiler cans 8*d* and 8*e* are situated at the input side of the drafting frame 6 to pay out sliver which is introduced into the drafting frame for doubling and twisting. It is to be understood that instead of six coiler cans 8*d* and 8*e* a greater or smaller number of coiler cans may be set in case a different type of doubling is desired.

For removing sliver residues from the coiler cans 8*c* a coiler can emptying device 10 is situated between the drafting frame 6 on the one hand and the carding machines 1–5 on the other hand. The coiler can emptying device 10 receives coiler cans 8 which contain sliver residues 39.

Also referring to FIGS. 2 and 3, on the chassis (undercarriage) 11 of the transporting carriage 9 carrier walls 12 are supported which, at the top, are interconnected by a transverse beam 13 provided with a throughgoing aperture 14 having a generally vertical central axis 14*a*. The aperture 14 is eccentric relative to a central vertical axis 9*a* of an inner carriage space (receiving bay) 9*b* dimensioned to accommodate the coiler can 8 and defined by walls 12 and transverse beam 13 of the carriage 9.

Figure 4:
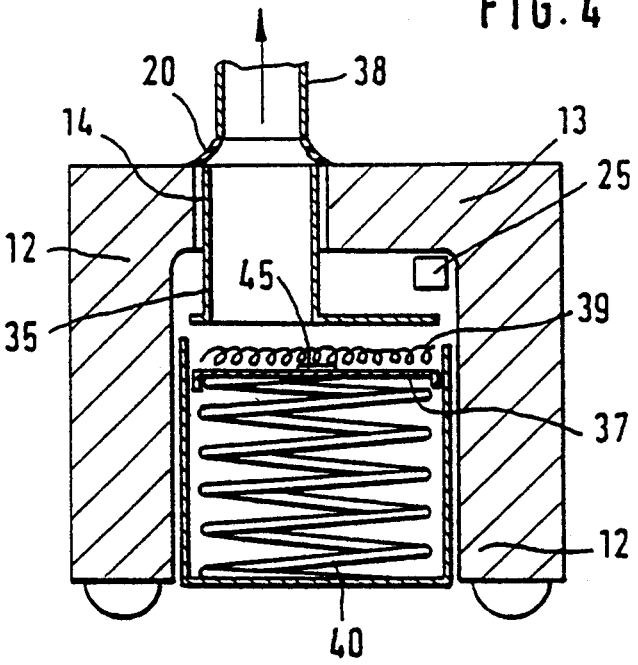
FIG. 4 is a sectional side elevational view of the construction shown in FIG. 2 illustrating a telescoping suction nozzle passing through the opening provided in the transverse carriage beam.

During its travel from the drafting frame 6 to one of the carding machines 1–5, the carriage 9 transports a coiler can 8*c* which is entirely or substantially empty. Any residual fiber material (sliver residues) 39 which may dwell in the coiler can 8*c* is detected by the sensor 25 which may be a transmitting or reflecting optical barrier as illustrated in FIGS. 2 and 4, respectively. The signals from the light barrier are applied to a microprocessor 43 which is supported in one of the carrier walls 12 of the carriage 9. At the same time, the still available fill height in the coiler can 8c is measured and compared with a preselected constant value previously inputted in the microprocessor 43. In case no sliver residues are detected in the coiler can 8c, the transporting carriage 9 passes through the can emptying device 10 without stopping to that one of the carding machines 1–5 which has requested an empty can 8. In case a substantial amount of sliver residue 39 is contained in a coiler can 8c, such a coiler can is first guided to a verifying station 46 where the can contents are checked and, if necessary, the can is manually emptied and in case the fiber material is usable, it is reintroduced into the fiber processing flow.

Figure 5:
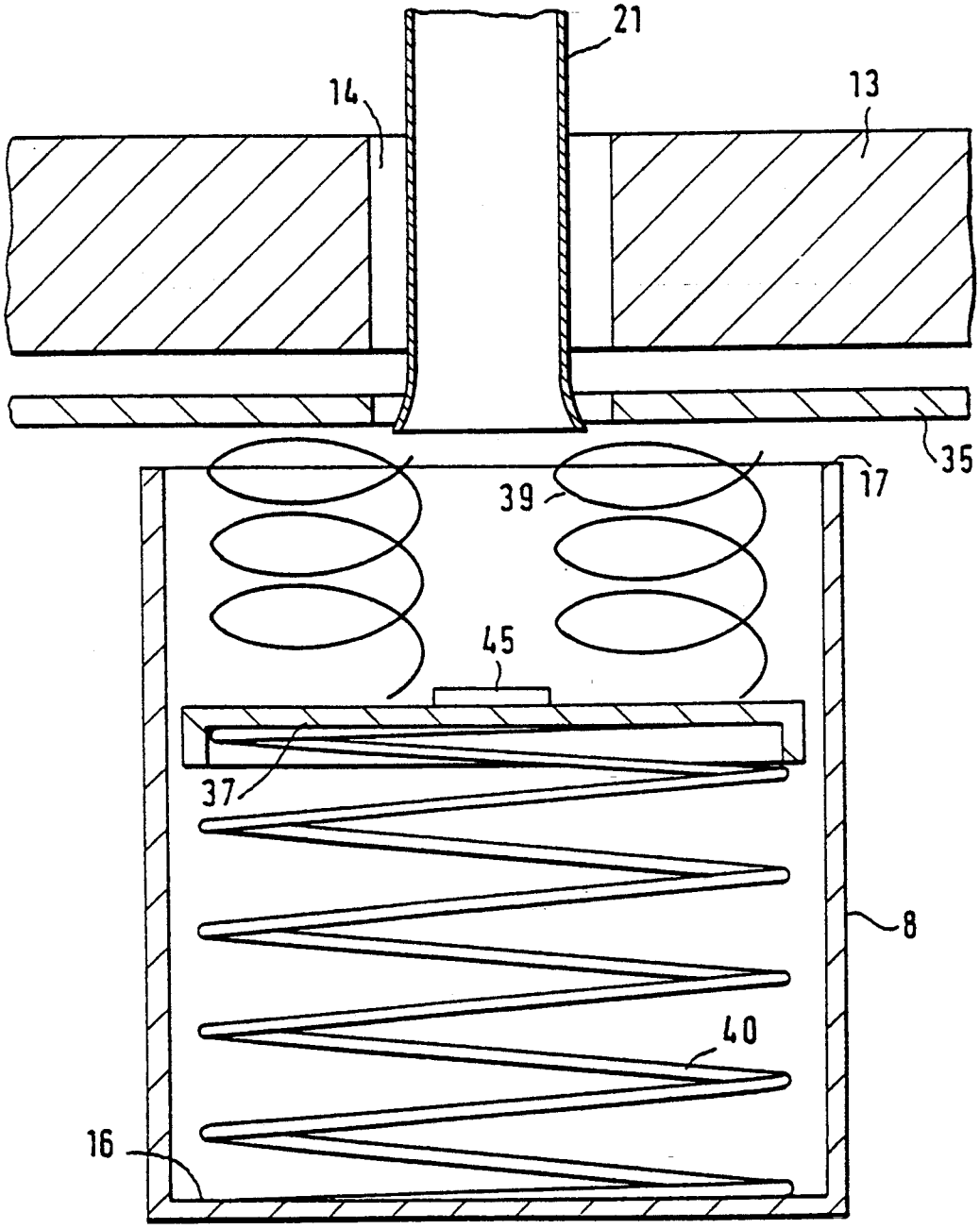
FIG. 5 is a fragmentary sectional elevational view of a transporting carriage and a suction nozzle extending through the opening of the transverse carriage beam.
Figure 8:
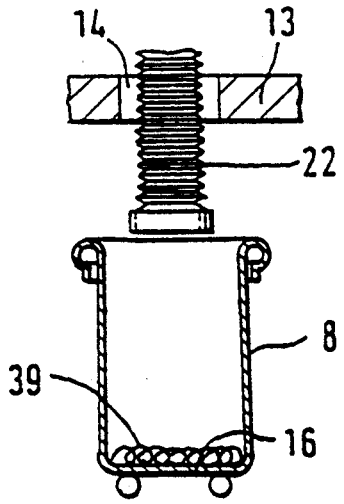
FIG. 8 is a sectional view of a bellows passing through an opening of a transverse carriage beam and being situated above a coiler can to be serviced.
Figure 9:
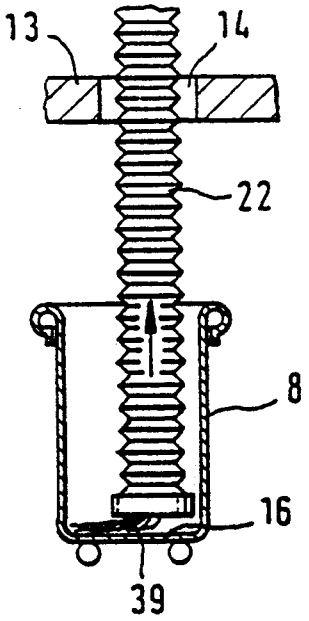
FIG. 9 is a view similar to FIG. 8 showing the bellows in an extended state.

In case the coiler can 8c accommodated in the transporting carriage 9 has a sliver residue quantity 39 which does not exceed 25% of the full load, the microprocessor 43 triggers a contact which reduces the travelling speed in the zone of the can emptying device 10 until, by means a further pulse by the position indicator 23, the transporting carriage 9 stops underneath the suction device (can emptying device) 10 such that the opening 14 in the transverse beam 13 of the transporting carriage 9 is in alignment with the nozzle end of the suction device 10. Dependent upon the particular embodiment of the transporting carriage 9 and the suction device 10, as shown in FIGS. 4, 5, 8 and 9, a suction nozzle 21 or a telescoping nozzle 38 is lowered through the opening 14. It is noted that, as shown in FIGS. 4 and 5, such a lowering is only slight, that is, the suction nozzle 21 or 38 just slightly projects through the opening at the underside of the transverse beam 13, because in such an embodiment the coiler cans 8 are provided with a vertically movable coiler can platform 37 which is lifted by a coiler can spring 40. In contrast, according to FIGS. 8 and 9, a suction bellows 22 is first passed through the opening 14 as shown in FIG. 8 and is then extended such that it is positioned close to the coiler can bottom 16 before the suction fan 24 (FIG. 6) is energized to generate a vacuum in the pipe 41. After emptying the can 8 in this manner, the bellows 22 or, as the case may be, the suction nozzle 21 or 38 is retracted and is again situated above the transverse beam 13 of the transporting carriage 9.

Figure 6:
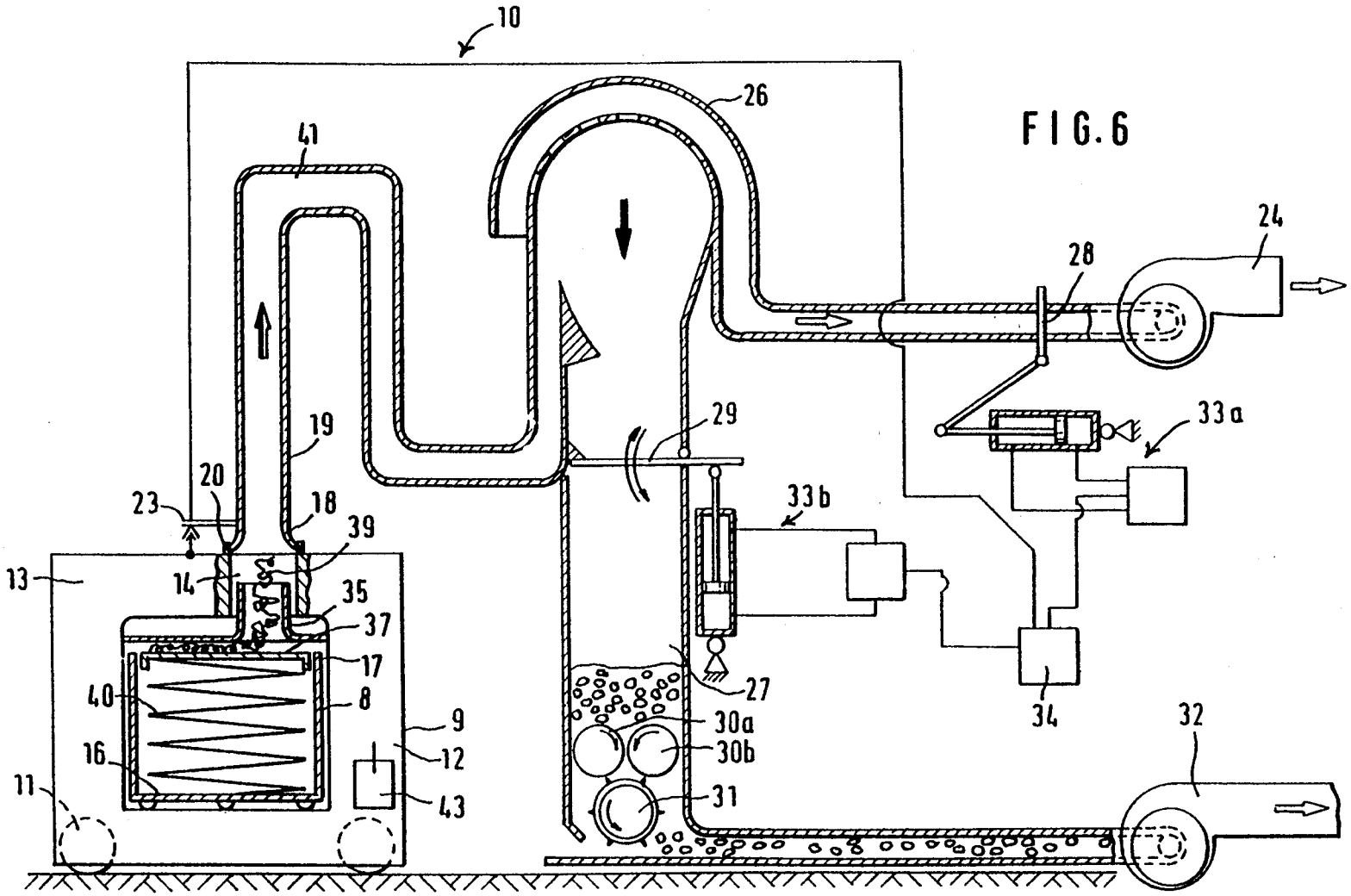
FIG. 6 is a schematic sectional side elevational view, with block diagram, of a suction device and a transporting carriage being serviced by the suction device.

According to an alternative embodiment as shown in FIG. 6, the introduction and positioning of the transporting carriage 9 in the can emptying device 10 is performed identically to the previously described embodiment, but the suction nozzle 41 at the nozzle end 19 is provided with an enlargement (suction hood) 18 which, with the intermediary of an elastomer seal 20 lies airtight on the transverse beam 13 and surrounds the opening 14. By virtue of the earlier-described eccentric position of the aperture 14 relative to the carriage space 9b (FIG. 2) and thus relative to the vertical axis of the coiler can, on the bottom platform 37 of the coiler can, in cooperation with the upstanding upper edge 17 therein, a turbulence is generated upon suction, enhancing the complete removal of the sliver residue from the coiler can.

Figure 7:
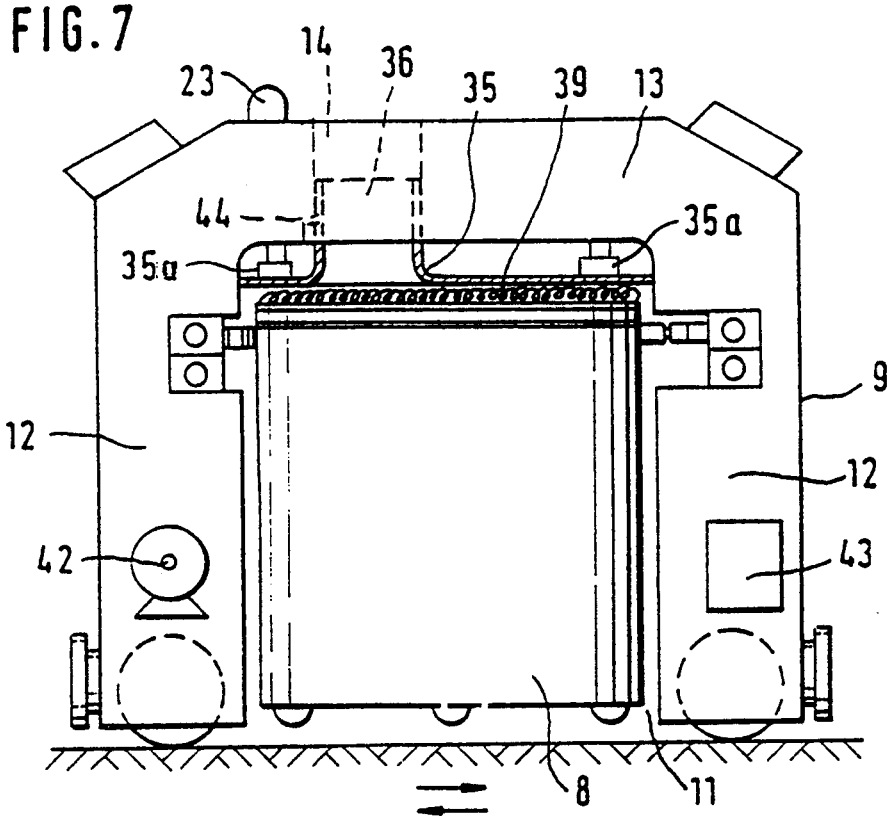
FIG. 7 is side elevational view of a transporting carriage with a built-in hold-down element, drive motor and microprocessor.

FIG. 7 shows a hold-down element 35 which is provided with a nipple 44 having an inner space 36. The nipple 44 engages the inner walls of the opening 14 and substantially seals the same in a downward direction. The sliver residues 39 engage the underside of the hold-down element 35. The hold-down element 35 is suspended from the transverse beam 13 by height-adjustable hangers 35a to set a height level of the hold-down element 35, so that coiler cans 8 of different heights may be accommodated.

As illustrated in FIGS. 4 and 5, the coiler can platform 37 is provided with a reflecting surface 45 so that the sensor 25 may function as an optical barrier of the reflecting light type. Thus, a light beam directed towards the coiler can platform 37 is reflected by the surface 45 and detected by the sensor 25, whereupon the distance of the platform 37 from the upper edge 17 of the coiler can 8 may be determined.

Referring in particular to FIG. 6, the sliver residues 39 drawn by suction through the pipe 41 are advanced by the suction fan 24 to a fiber material separator 26 and is deposited as a filter cake-like material. By closing a shutoff gate 28 by a power cylinder unit 33a operated by the control device 34, the separated fiber material is admitted to the switchable gate 29 which, when opened by a power cylinder unit 33b actuated by the control device 34, allows the fiber material to be admitted into the fiber material storage 27 and lies on the delivery rolls 30a, 30b. Underneath the delivery rolls 30a, 30b there is arranged a rapidly rotating opening roll 31 which opens the fiber material into fiber tufts which then, by means of a fiber transporting fan 32 are forwarded for further processing, that is, are reintroduced into the fiber processing flow. The suction air stream separated from the fiber material leaves the device 10 through a conduit 26 connected to the suction fan 24.

Upon completion of the coiler can emptying process, a pulse is generated by the microprocessor 43 which switches on the drive motor 42 of the transporting carriage 9 which, as a result, continues its travel from the coiler can emptying device 10 to the carding machines 1–5.

Figure 10A:
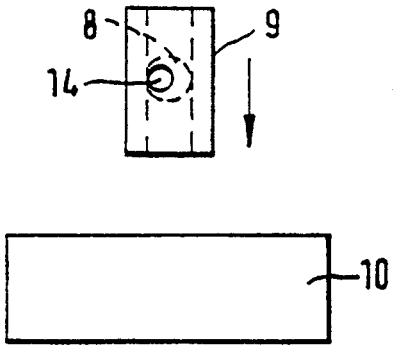
FIG. 10*a*, 10*b* and 10*c* are schematic top plan views of a can emptying device showing the can in different positions.
Figure 10B:
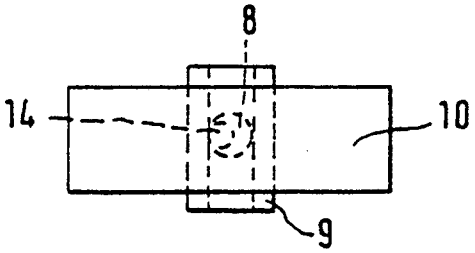
Figure 10C:
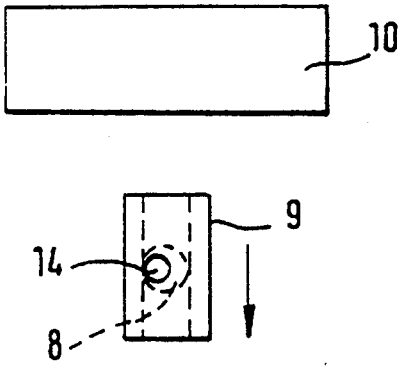
Figure 11A:
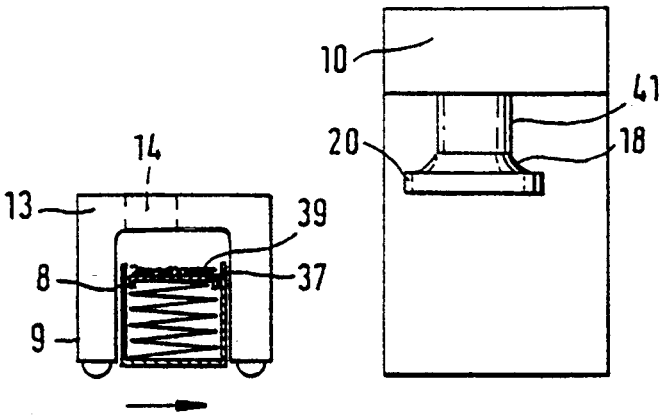
FIGS. 11*a*, 11*b* and 11*c* are schematic side elevational views of the structures illustrated in FIGS. 10*a*, 10*b* and 10*c*, respectively.
Figure 11B:
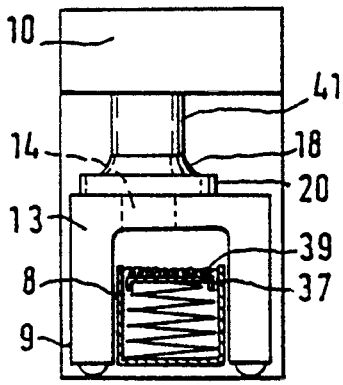
Figure 11C:
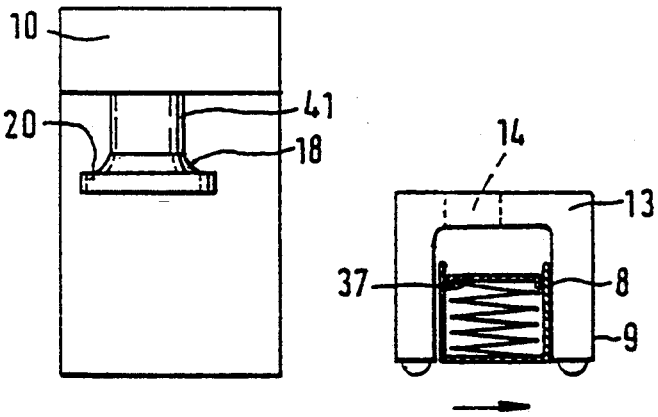

FIGS. 10a and 11a show the transporting carriage 9 and coiler can 8 approaching the can emptying device 10; FIGS. 10b and 11b illustrate the emptying (suction) operation as the carriage 9 dwells underneath the suction nozzle 41; and FIGS. 10c and 11c show the carriage 9 and coiler can 8 moving away from the can emptying device 10.

It will be understood that the above description of the present invention is susceptible to various modifications, changes and adaptations, and the same are intended to be comprehended within the meaning and range of equivalents of the appended claims.

What is claimed is:

1. An apparatus for removing sliver residues from a coiler can, comprising (a) a transporting carriage for transporting a coiler can along a path of travel; said transporting carriage including (1) an undercarriage;

(2) two generally vertically oriented walls supported on said undercarriage and having respective upper portions;

(3) a transverse beam interconnecting said walls at the upper portions thereof;

(4) a receiving bay defined together by said walls and said transverse beam for accommodating a coiler can; said receiving bay having a central vertical axis; and (5) a generally vertically oriented throughgoing aperture provided in said transverse beam and situated above said receiving bay; and (b) a suction device including a suction nozzle being in alignment with said throughgoing aperture and extending from above theretoward when said transporting carriage is in position at said suction device.

2. The apparatus as defined in claim 1, wherein said suction device is stationary.

3. The apparatus as defined in claim 1, wherein said throughgoing aperture is eccentric relative to said central vertical axis.

4. The apparatus as defined in claim 1, wherein said throughgoing aperture has a circular outline.

5. The apparatus as defined in claim 1, wherein said suction nozzle has a diameter that is less than a diameter of said throughgoing aperture, whereby said suction nozzle is introducible through said throughgoing aperture into a coiler can situated in said receiving bay.

6. The apparatus as defined in claim 1, further comprising a position indicator mounted on one of said transporting carriage and said suction device for determining a relative position between said transporting carriage and said suction device.

7. The apparatus as defined in claim 1, further comprising sensor means mounted on one of said transverse beam and said suction nozzle for determining a distance of a bottom of the coiler can situated in said receiving bay from said sensor means.

8. The apparatus as defined in claim 1, wherein said suction nozzle has a diameter that is greater than a diameter of said throughgoing aperture.

9. The apparatus as defined in claim 8, wherein said suction nozzle comprises a suction hood adapted to engage an upper outer surface of said transverse beam.

10. The apparatus as defined in claim 8, further comprising an elastomer sealing ring surrounding said suction nozzle and being adapted to engage an upper outer surface of said transverse beam.

11. The apparatus as defined in claim 1, wherein said suction device comprises a suction generator and a suction conduit connected to said suction generator and terminating in said suction nozzle.

12. The apparatus as defined in claim 11, further comprising a separator means situated between said suction nozzle and said suction generator for separating the sliver residues from the suction air stream.

13. The apparatus as defined in claim 12, further comprising a fiber storing device situated underneath said separator means for receiving the separated sliver residues.

14. The apparatus as defined in claim 13, further comprising a gate disposed between said separator means and said fiber storing device; said gate having open and closed positions; and power means for moving said gate.

15. The apparatus as defined in claim 13, further comprising a shutoff gate mounted in said suction conduit between said fiber storing device and said suction generator; said shutoff gate having open and closed positions; and power means for moving said shutoff gate.

16. The apparatus as defined in claim 13, wherein said fiber storing device comprises a feed chute having a lower portion; further comprising delivery means situated at said lower portion of said feed chute for removing sliver residues therefrom.

17. The apparatus as defined in claim 16, further comprising an additional suction conduit connected to said lower portion of said feed chute and an additional suction fan connected to said additional suction conduit for removing sliver residues withdrawn from said feed chute by said delivery means.

18. The apparatus as defined in claim 13, further comprising an electronic control and regulating device; a first shutoff gate mounted in said suction conduit between said fiber storing device and said suction generator; said first shutoff gate having open and closed positions; first power means for moving said first shutoff gate; a second shutoff gate disposed between said separator means and said fiber storing device; said second shutoff gate having open and closed positions; second power means for moving said second shutoff gate; said first and second power means are connected to said electronic control and regulating device.

19. The apparatus as defined in claim 1, further comprising a position indicator mounted on one of said transporting carriage and said suction device for determining a relative position between said transporting carriage and said suction device; an electronic control and regulating device and motor means for propelling said transporting carriage; said motor means and said position indicator being connected to said electronic control and regulating device.

20. The apparatus as defined in claim 1, further comprising a hold-down element for engaging sliver residues projecting from the coiler can positioned in said receiving bay; said hold-down element being situated immediately underneath said transverse beam in an upper part of said receiving bay; and height-adjustable suspending means height-adjustably securing said hold-down element to said transverse beam; further comprising an opening provided in said hold-down element.

21. The apparatus as defined in claim 20, further comprising a tubular nipple forming part of said hold-down element and extending therefrom into said throughgoing aperture of said transverse beam.

* * * * *